US011603867B2

(12) United States Patent
Dany et al.

(10) Patent No.: US 11,603,867 B2
(45) Date of Patent: Mar. 14, 2023

(54) ELECTROHYDROSTATIC ACTUATOR SYSTEM WITH AN EXPANSION RESERVOIR

(71) Applicant: Moog GmbH, Boblingen (DE)

(72) Inventors: Sascha Dany, Detzem (DE); Reiner Kohlhaas, Osburg (DE); Achim Helbig, Stuttgart (DE); Werner Handle, Marbach am Neckar (DE)

(73) Assignee: Moog GmbH, Boblingen (DE)

( * ) Notice: Subject to any disclaimer, the term of this patent is extended or adjusted under 35 U.S.C. 154(b) by 0 days.

(21) Appl. No.: 17/268,318

(22) PCT Filed: Aug. 8, 2019

(86) PCT No.: PCT/EP2019/071360
§ 371 (c)(1),
(2) Date: Feb. 12, 2021

(87) PCT Pub. No.: WO2020/035398
PCT Pub. Date: Feb. 20, 2020

(65) Prior Publication Data

US 2021/0332831 A1 Oct. 28, 2021

(30) Foreign Application Priority Data

Aug. 16, 2018 (DE) ..... 102018120000.5

(51) Int. Cl.
*F15B 1/26* (2006.01)
*F15B 7/00* (2006.01)
*F15B 11/17* (2006.01)

(52) U.S. Cl.
CPC ..... *F15B 1/26* (2013.01); *F15B 7/006* (2013.01); *F15B 11/17* (2013.01);
(Continued)

(58) Field of Classification Search
CPC ..... F15B 2211/212; F15B 2211/20592; F15B 11/17; F15B 11/18
(Continued)

(56) References Cited

U.S. PATENT DOCUMENTS 5,568,766 A 10/1996 Otremba et al.
8,820,064 B2 * 9/2014 Six ..... B60G 17/056 60/414
(Continued)

FOREIGN PATENT DOCUMENTS

CN 102272460 A 12/2011
CN 103201093 A 7/2013
(Continued)

OTHER PUBLICATIONS

International Search Report and Written Opinion in International Patent Application No. PCT/EP2019/071360, dated Nov. 5, 2019.
(Continued)

*Primary Examiner* — Abiy Teka
*Assistant Examiner* — Daniel S Collins
(74) *Attorney, Agent, or Firm* — Harter Secrest & Emery LLP

(57) ABSTRACT

An electrohydrostatic actuator system comprising: a volume- and/or speed-variable hydraulic machine which is driven by an electric motor, for providing a volumetric flow of a hydraulic fluid; a differential cylinder with a piston side and a ring side; and at least one pretensioning source. The actuator system has a closed hydraulic circuit, wherein, during operation, the hydraulic fluid in the hydraulic circuit is pressurized by means of the hydraulic machine and/or the pretensioning source. Furthermore, according to the invention, the differential cylinder provides a power motion operating mode and a rapid motion operating mode. In order to balance a volume of the hydraulic fluid in the closed
(Continued)

Rapid motion down

Figure 1:
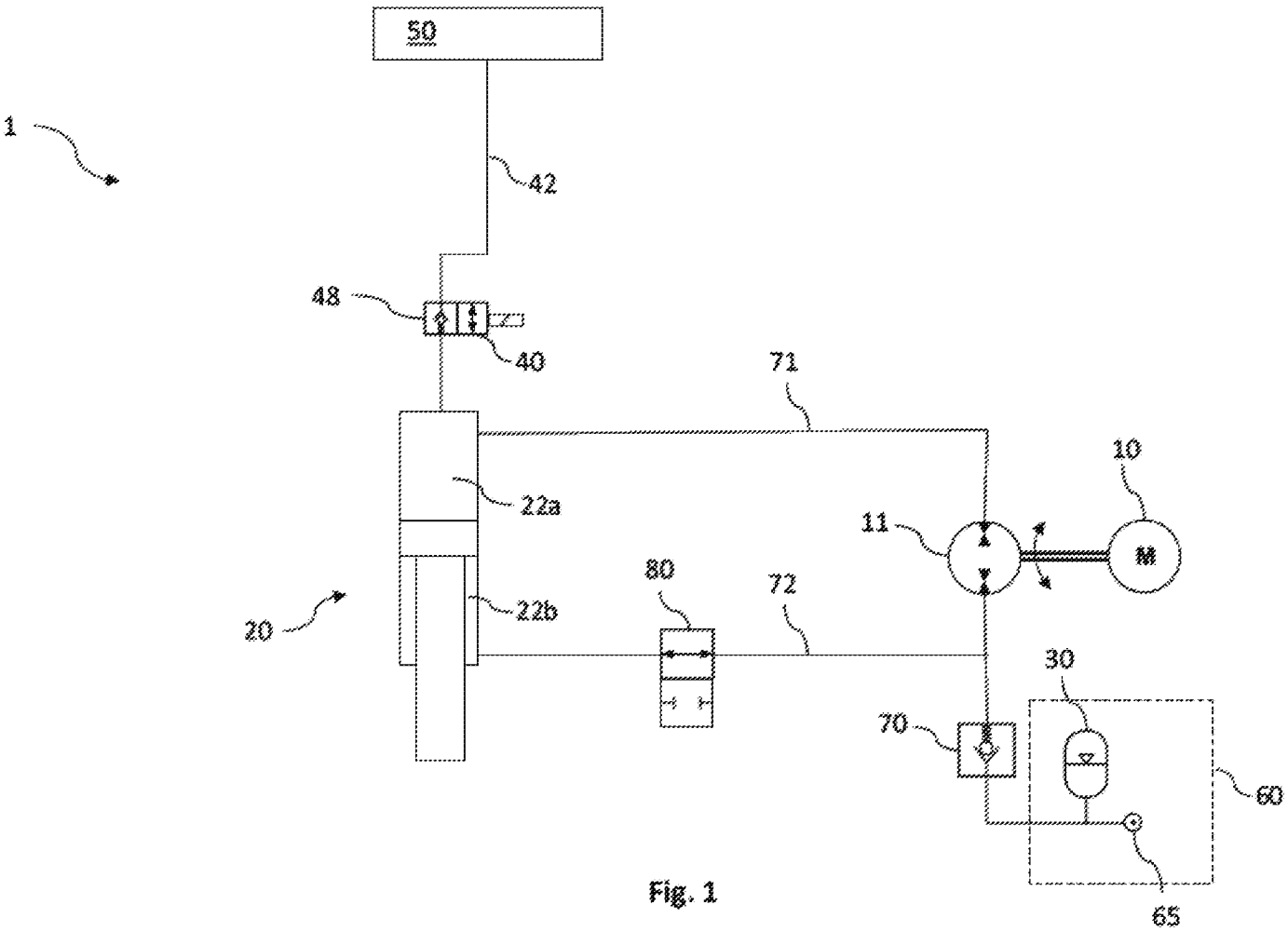

Power motion down hydraulic circuit, according to the invention an expansion reservoir is connected to the piston side of the differential cylinder via a valve.

20 Claims, 7 Drawing Sheets

(52) U.S. Cl.
CPC ..... *F15B 2211/20561* (2013.01); *F15B 2211/20592* (2013.01); *F15B 2211/212* (2013.01); *F15B 2211/27* (2013.01); *F15B 2211/615* (2013.01); *F15B 2211/62* (2013.01)

(58) Field of Classification Search
USPC ..... 60/475, 476
See application file for complete search history.

(56) References Cited

U.S. PATENT DOCUMENTS

| | | | | |
|---|---|---|---|---|
| 10,302,101 | B2 | 5/2019 | Schaber | |
| 10,519,989 | B2 | 12/2019 | Handle et al. | |
| 10,626,889 | B2 | 4/2020 | Händle et al. | |
| 2003/0159599 | A1* | 8/2003 | Ariji | B30B 15/161 100/269.1 |
| 2011/0180160 | A1 | 7/2011 | Froehlich et al. | |
| 2018/0185900 | A1* | 7/2018 | Otto | B21J 11/00 |
| 2019/0162208 | A1 | 5/2019 | Haendle et al. | |

FOREIGN PATENT DOCUMENTS

| | | | |
|---|---|---|---|
| CN | 103790894 | A | 5/2014 |
| CN | 105697435 | A | 6/2016 |
| CN | 106246618 | A | 12/2016 |
| CN | 106460874 | A | 2/2017 |
| CN | 107109961 | A | 8/2017 |
| DE | 102009043034 | A1 | 3/2011 |
| EP | 3272511 | A1 | 1/2018 |
| WO | 2012055579 | A1 | 5/2012 |
| WO | 2012062416 | A1 | 5/2012 |
| WO | 2015177228 | A1 | 11/2015 |
| WO | 2018028944 | A1 | 2/2018 |

OTHER PUBLICATIONS

International Preliminary Report on Patentability in International Patent Application No. PCT/EP2019/071360, dated Dec. 21, 2020.

* cited by examiner

Power motion down

Rapid motion down

Alternative decompression

Decompression

Rapid motion up

ELECTROHYDROSTATIC ACTUATOR SYSTEM WITH AN EXPANSION RESERVOIR

The present invention relates to an electrohydrostatic actuator system, and in particular to an electrohydrostatic actuator system having an expansion reservoir.

Electrohydrostatic actuator systems are known in the prior art and are mainly used for injection-molding machines, presses, and deep-drawing devices. Conventionally, actuator systems of the prior art have at least one cylinder with unequal surface ratios. This inequality leads to a volume difference in the flow of the hydraulic fluid in the system, which is advantageous neither for the movement sequence nor for the maintenance of the system.

The pressure accumulators usually used in such systems maintain the pressure in the system, but their ability to balance a volume difference is at least partially restricted by the usually small accumulator volume and generally leads to a pressure increase or pressure drop.

In addition, conventional actuator systems are used to cool and clean the hydraulic fluid by leakages and flushing of the pump. Because of the limited volumetric flow available at such points, the cooling is severely limited, which is why both an increased expenditure of energy and an increased expenditure of time are necessary in order to provide an increase in the cooling capacity.

Based upon this prior art, it is an aim of the present invention to at least partially overcome or improve upon the disadvantages of the prior art.

The aim is achieved with a device according to claim 1. Preferred embodiments and modifications are the subject matter of the subclaims. A method according to the invention for using the system according to the invention is specified in claim 19.

The electrohydrostatic actuator system according to the invention comprises: a hydraulic machine, driven by an electric motor, which is volume- and/or speed-variable, for providing a volumetric flow of a hydraulic fluid; a differential cylinder having a piston side and a ring side; and at least one pretensioning source.

The actuator system has a closed hydraulic circuit, wherein, during operation, the hydraulic fluid in the hydraulic circuit is pressurized by means of the hydraulic machine and/or the pretensioning source. Furthermore, according to the invention, the differential cylinder provides the operating modes of a power motion and a rapid motion.

To balance a volume of the hydraulic fluid in the closed hydraulic circuit, according to the invention, an expansion reservoir is connected to the piston side of the differential cylinder via a valve.

The actuator system according to the invention is referred to as an electrohydrostatic actuator system, since it has both an electric motor and a hydraulic machine for providing a volumetric flow of a hydraulic fluid, and the cylinder is coupled to the hydraulic machine via a hydrostatic transmission.

Electric motors are known in the prior art and serve to drive the hydraulic machine.

The hydraulic machine is variable in volume and/or speed and can preferably provide two possible flow directions of the hydraulic fluid in the closed hydraulic circuit during operation. The hydraulic machine may further have either an electric motor with variable rotational speed and a fixed displacement pump, or an electric motor with constant rotational speed and a variable displacement pump, or an electric motor with variable rotational speed and a variable displacement pump. The selection of the hydraulic machine is thereby determined by factors such as, for example, system costs, reliability, or permitted noise emission, or efficiency.

The actuator system furthermore has a differential cylinder, which comprises a ring side and a piston side, and also an annular surface and a piston surface. A differential cylinder is understood to mean a hydraulic cylinder in which the cylinder surfaces differ on the front and rear sides of the piston. The side with the smaller cylinder surface is referred to as the rod side because a piston rod is arranged on this side. The cylindrical surface on the rod side is called an annular surface. The side with the larger cylindrical surface of a differential cylinder is what is known as the piston side. Either no piston rod, or a piston rod having a smaller diameter than on the rod side, is arranged on the piston side. The cylinder surface on the piston side is called the piston surface.

According to the invention, the differential cylinder provides the operating modes of a power motion and a rapid motion.

The drive system provides a movement of the cylinder, i.e., of the differential cylinder, in a first direction, e.g., towards the workpiece to be machined. This is achieved by means of a volumetric flow from the hydraulic machine or into or out of the expansion reservoir. The pretensioning source provides pretension to the hydrostatic transmission and provides fluid to the hydraulic machine for compressing the hydraulic fluid. In the process, a controller and additional components—e.g., valves—may coordinate the volumetric flow in accordance with the required movement sequences.

Furthermore, the drive system provides a movement of the cylinder in a second direction, e.g., in the direction opposite the above-mentioned direction. This is also achieved by means of a volumetric flow of the hydraulic machine and a volumetric flow rate into or out of the expansion reservoir.

An electro-hydrostatic system according to the invention provides at least a power motion operating mode and a rapid motion operating mode. These operating modes are provided by the differential cylinder. The differential cylinder may be realized as a cylinder or as a plurality of cylinders operating in parallel. These additional cylinders may optionally have a different movement sequence than the differential cylinder (master cylinder); however, they are part of the electro-hydrostatic system according to the invention, and part of the closed hydraulic circuit.

The piston surface acts in power motion, i.e., high force at a comparatively lower low speed. In rapid motion, the annular surface, which is smaller than the piston surface, i.e., low force, acts at high speed.

Furthermore, the actuator system according to the invention has a pretensioning source. This can additionally have an accumulator for buffering the pretensioning pressure, wherein this accumulator generally has a smaller volume than the expansion reservoir. The hydraulic fluid provided from the pretensioning source is pretensioned at a pressure between 5 bar and 50 bar—in particular, between 10 bar and 40 bar, preferably between 15 bar and 35 bar, and particularly preferably between 20 bar and 30 bar.

In particular, an increased pressure of the hydraulic fluid is necessary in the power motion operating mode, wherein the hydraulic fluid is acted upon by means of the hydraulic machine. The pretensioning source thereby provides the required fluid for compression.

In another embodiment according to the invention, the hydraulic machine can be pressurized on both pump connections, i.e., on the connection in the direction of the piston side of the differential cylinder and on the connection in the direction of the ring side of the differential cylinder.

In the following description, the terms, "pressure in the pressure accumulator," "piston side/ring side pressure," or variations thereof, refer to the pressure of the hydraulic fluid in the respective apparatuses. The same applies to the term, "volume," so that, for example, "low volume in the pressure accumulator" means a low volume of hydraulic fluid in the pressure accumulator.

In one embodiment of the present invention, the pretensioning source is hydraulically connected via a valve to the hydraulic machine and the ring side of the differential cylinder.

In particular, in a further embodiment according to the invention, the valve can be a check valve which, at a threshold pressure, feeds pretensioned hydraulic fluid from the pretensioning source into the system.

Through the suitable selection of a check valve, and, in particular, through the selection of the spring of the check valve, it is possible to determine the pressure difference, between the inlet and outlet of the valve, above which the valve opens.

In a further preferred embodiment of the electrohydrostatic system according to the invention, the pretensioning source can, in particular, also comprise a pressure accumulator and/or an additional pump.

In another embodiment according to the invention, a valve—especially, a proportional valve—is arranged at the connection between the pretensioning source and the piston side of the differential cylinder or between the piston side of the differential cylinder and the expansion reservoir.

Since the cylinder in the actuator system according to the invention is a differential cylinder, the piston side and the ring side have various volumes or surfaces.

For example, when the cylinder is pressed towards the tool, the hydraulic fluid flows from the ring side of the differential cylinder into the piston side of the differential cylinder via the hydraulic machine. Since the ring side has a smaller volume than the piston side, additional hydraulic fluid volume is necessary in order to fill the piston side and to provide pressure balancing. The pretensioning source generally has a small volume of hydraulic fluid; this is usually too small to balance the volume difference between the piston side and the ring side, since the pretensioning source is mainly used for avoiding cavitations of the hydraulic machine, and not for full volume balancing.

According to the invention, an expansion reservoir is integrated into the system. In particular, the expansion reservoir is connected directly to the piston side of the differential cylinder and, preferably, hydraulically to the latter, by means of a check valve. The check valve opens, for example, as soon as a negative pressure at the piston side of the differential cylinder exists relative to the expansion reservoir. A flow is thus provided from the expansion reservoir into the piston side, which balances the volume difference.

The expansion reservoir is pretensioned at a lower pressure—preferably, and according a further embodiment according to the invention, at a pressure of less than 5 bar, in particular less than 4 bar, preferably less than 3 bar, particularly preferably less than 2 bar, and particularly preferably less than 1 bar. This allows the check valve to open only when the pressure in the piston side is actually too low, and the volume difference has to be balanced.

In addition, the expansion reservoir can thus be disconnected from false air or acted upon with a protective gas, as a result of which, among other things, oxidation of the hydraulic fluid is reduced.

Essentially, the hydraulic fluid in the expansion reservoir according to another embodiment according to the invention has the ambient pressure and/or is arranged above the piston side of the differential cylinder. Alternatively, and also according to the invention, the expansion reservoir can be arranged below the piston side of the differential cylinder, in which case a volumetric flow from the expansion reservoir into the piston side of the differential cylinder then has to be actively provided, such as by suction, and is not automatically ensured by gravity.

In another embodiment according to the invention, the expansion reservoir has a volume which is equal to or more than the volume difference of the closed system in a power end position and upper end position of the differential cylinder.

The expansion reservoir is hydraulically connected to the piston side of the differential cylinder via a valve. According to the invention, the valve can be a controlled check valve, and, especially, an unlockable check valve.

Furthermore, in a further embodiment according to the invention, the valve can be an unlockable check valve which can be unlocked by means of a control circuit and a directional valve.

It is also within the meaning of an embodiment according to the invention for the valve to be a controlled, 2-way valve with a flow position and a check function, or an electrically-controlled, 3-way valve with a flow position, a locking position, and a check function.

The use of a controlled check valve between the expansion reservoir and the piston side of the differential cylinder is particularly advantageous during rapid motion, in order to keep the valve actively open, or also during decompression.

The decompression of the system takes place between the power motion operating mode and the rapid motion operating mode. After the workpiece has been machined at elevated pressure, it must be relaxed first before the cylinder can be moved in rapid motion; this is done by decompressing the hydraulic fluid in the system.

If the check valve is controllable between the expansion reservoir and the piston side of the cylinder, or if the check valve is embedded in a 2-way valve which has a flow position, it can be opened during decompression, so that the pressure in the system relaxes, and a volumetric flow can take place from the piston side of the differential cylinder back into the expansion reservoir.

The pressure level of the expansion reservoir is independent of the pretensioning of the pump. The expansion reservoir balances the lack of oil volume in the system, which is required at varying temperatures in the system and/or during compression of the smaller cylinder surface and, generally, during the process. Furthermore, the formation of cavitations is thus also at least partially prevented.

In an embodiment of the system according to the invention, a further valve having a flow position and a locking position is arranged in the line between the ring side of the differential cylinder and a connection of the hydraulic machine.

This is preferably to be understood as a safety valve. If a problem occurs in the system and it is necessary to stop the cylinder without causing the cylinder to fall, this valve can be set to the locking position. In all other situations, this valve is set to flow.

If the pretensioning source is configured as a pump, according to a further embodiment according to the invention, the pump inlet is connected via a line to the expansion reservoir, while the pump outlet is integrated into the circuit via a further line with a valve or check valve.

In this embodiment, the expansion reservoir is hydraulically connected to two lines. One line connects the expansion reservoir to the piston side of the differential cylinder, while the other line hydraulically connects the expansion reservoir to a section between the hydraulic machine and the ring side of the differential cylinder.

In this additional line, in this embodiment according to the invention, a further pump is arranged, which simultaneously assumes the function of the pretensioning source, i.e., the pump acts upon the hydraulic fluid with sufficient pressure around the pretensioning of the hydraulic machine. In this embodiment, the hydraulic fluid is taken directly from the expansion reservoir.

In a further embodiment according to the invention, the closed system has a device for cleaning the hydraulic fluid. Furthermore, in one embodiment of the system, the device is preferably arranged between the expansion reservoir and a pump inlet of the pump, or between a pump outlet of the pump and a check valve.

Additionally or alternatively, in a further embodiment according to the invention, the expansion reservoir can have a device for venting the hydraulic fluid and/or a device for cooling the hydraulic fluid.

The additional pump thus provides a volumetric flow of hydraulic fluid from the expansion reservoir through the additional line and, in a further embodiment according to the invention, through a cleaning device.

The arrangement of auxiliary units in the reservoir, such as filtering devices, cooling devices, and venting devices for filtering, cooling, or venting the hydraulic fluid contained in the reservoir, is also advantageous.

In order to clean hydraulic fluid, the hydraulic fluid must be in motion. The flow can, for example, be provided in the expansion reservoir by a further circuit. It is advantageous in the case of the embodiment described above that both cleaning and pressure are applied by means of a further line, as a result of which energy, material, and cost savings occur.

The contaminated hydraulic fluid is conducted, e.g., during decompression, into the expansion reservoir, from where it can be cleaned by this additional line and fed back into the circuit.

Furthermore, in contrast to the systems in which the cleaning or venting takes place by means of leakages and rinsing oil, in this case a larger volumetric flow is treated.

The valve, which is arranged between the piston side and the expansion reservoir, can be opened according to further embodiments according to the invention. During decompression, hydraulic fluid thereby flows, for example, from the piston side of the differential cylinder into the expansion reservoir. This hydraulic fluid contains impurities and is usually very warm due to the friction, which is why filtration and cooling of this fluid is also advantageous for maintenance of the entire system.

The system according to the invention is not limited to a single differential cylinder, and, in further embodiments according to the invention, may also have several differential cylinders which work with each other or independently of one another, but are arranged in the same system.

The system according to the invention in one of its embodiments can be embedded in particular in a method according to the invention in which, when the actuator system is extended in rapid motion, the expansion reservoir for balancing a volume of the hydraulic fluid in the closed system delivers hydraulic fluid into the piston side of the differential cylinder.

The entire system according to the invention and the method according to the invention for operating the system are provided according to the invention for use in a hydraulic press, a deep-drawing device, an injection-molding device or the like.

The invention is explained in the following on the basis of various exemplary embodiments, wherein it is noted that these examples include modifications or additions as they immediately arise for the person skilled in the art.

Figure 2B:
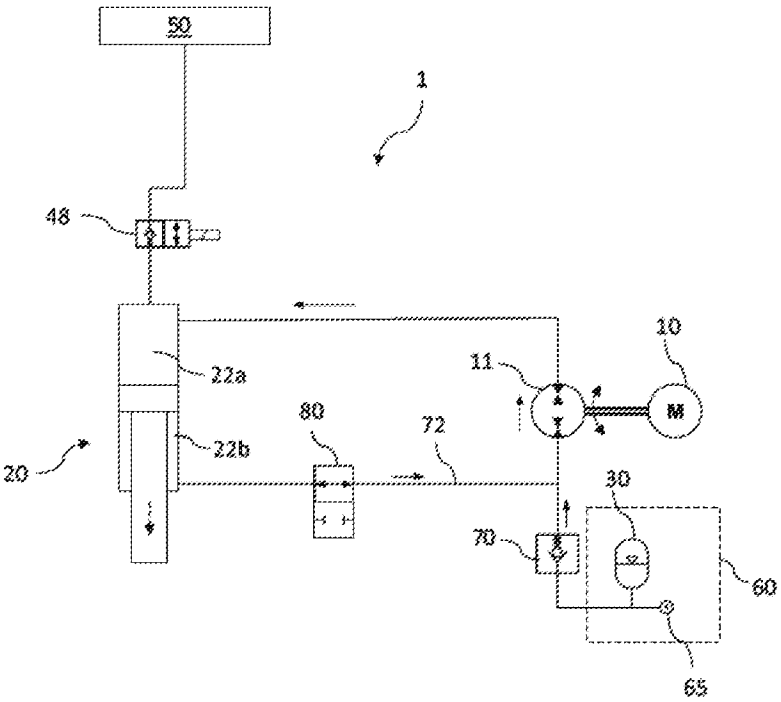
Figure 2A:
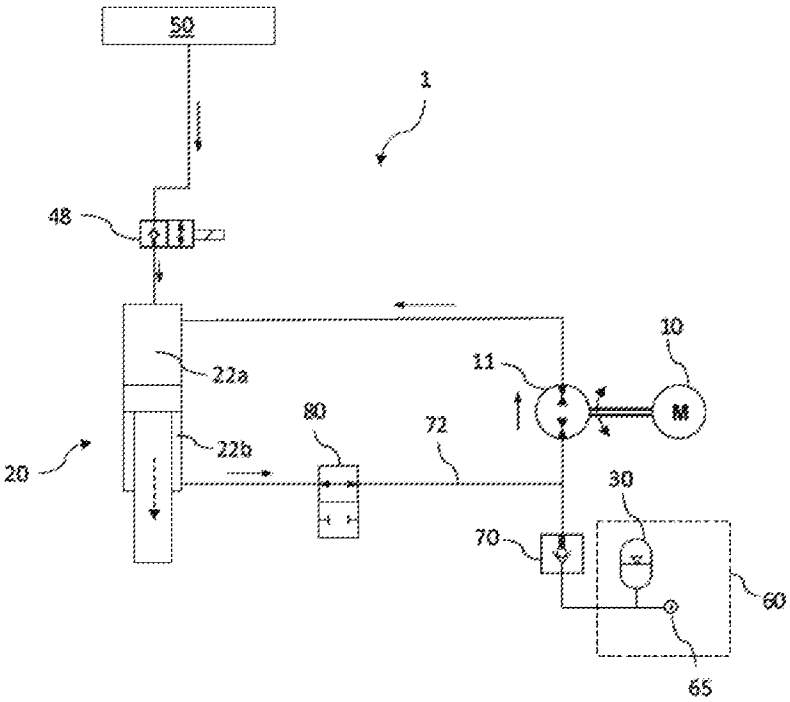
Figure 2D:
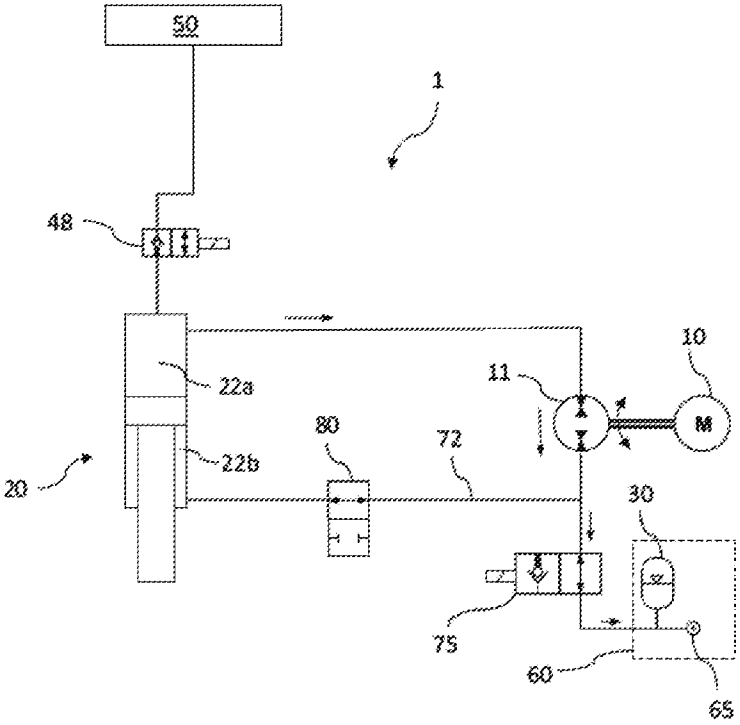
Figure 2C:
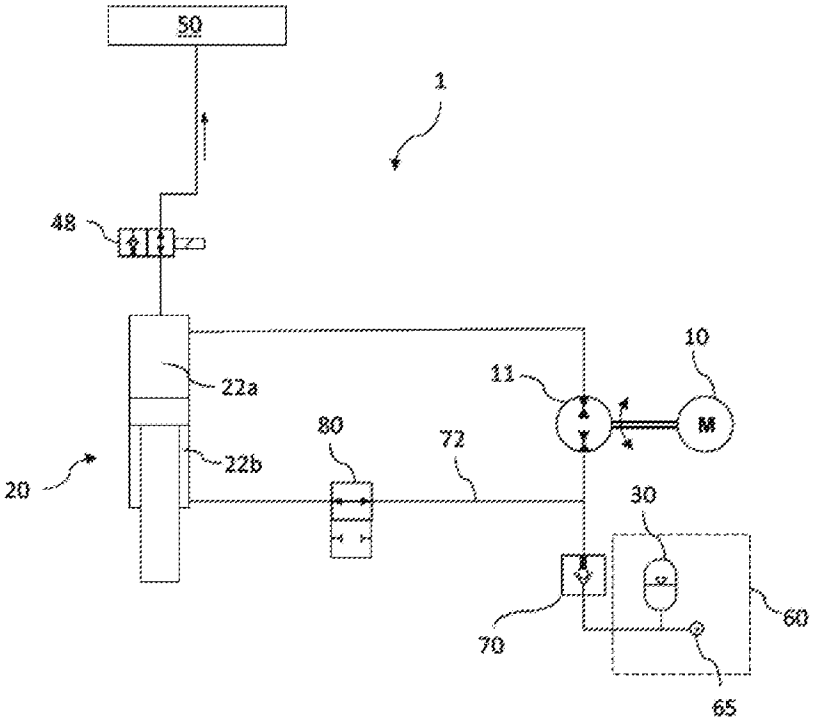
Figure 2E:
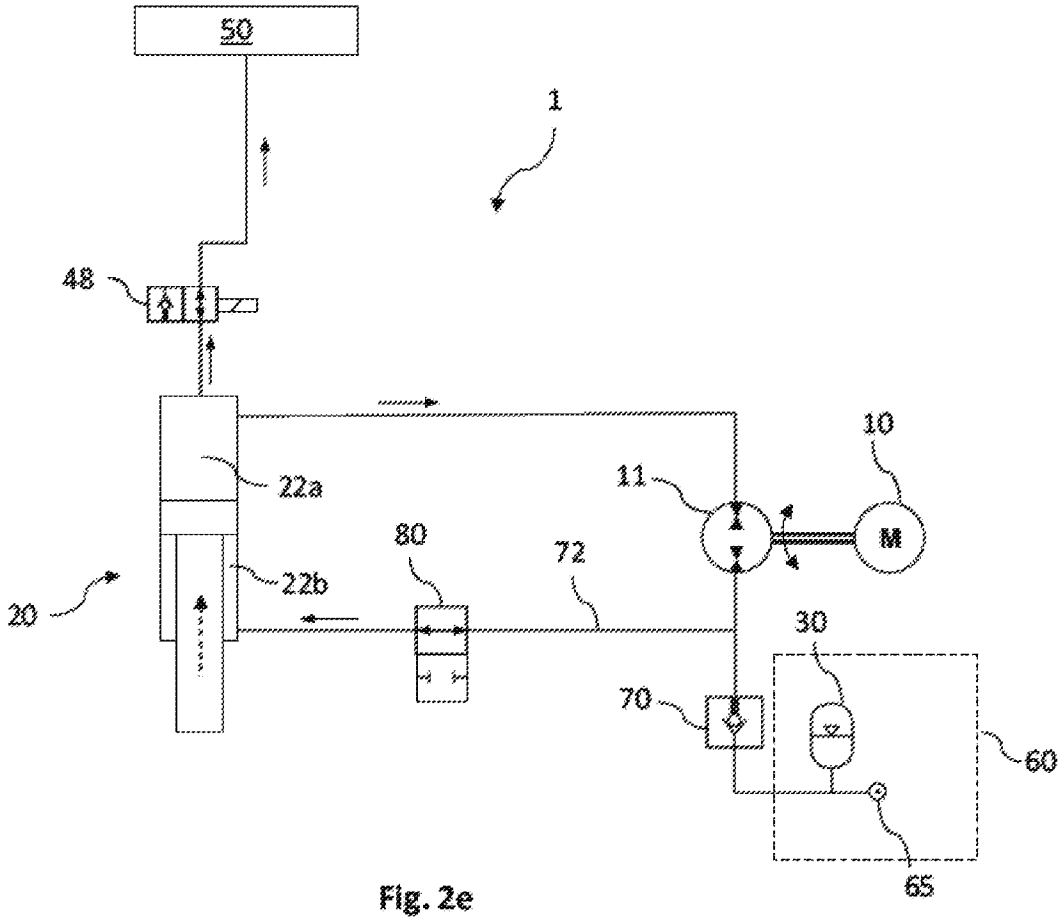
Figure 3:
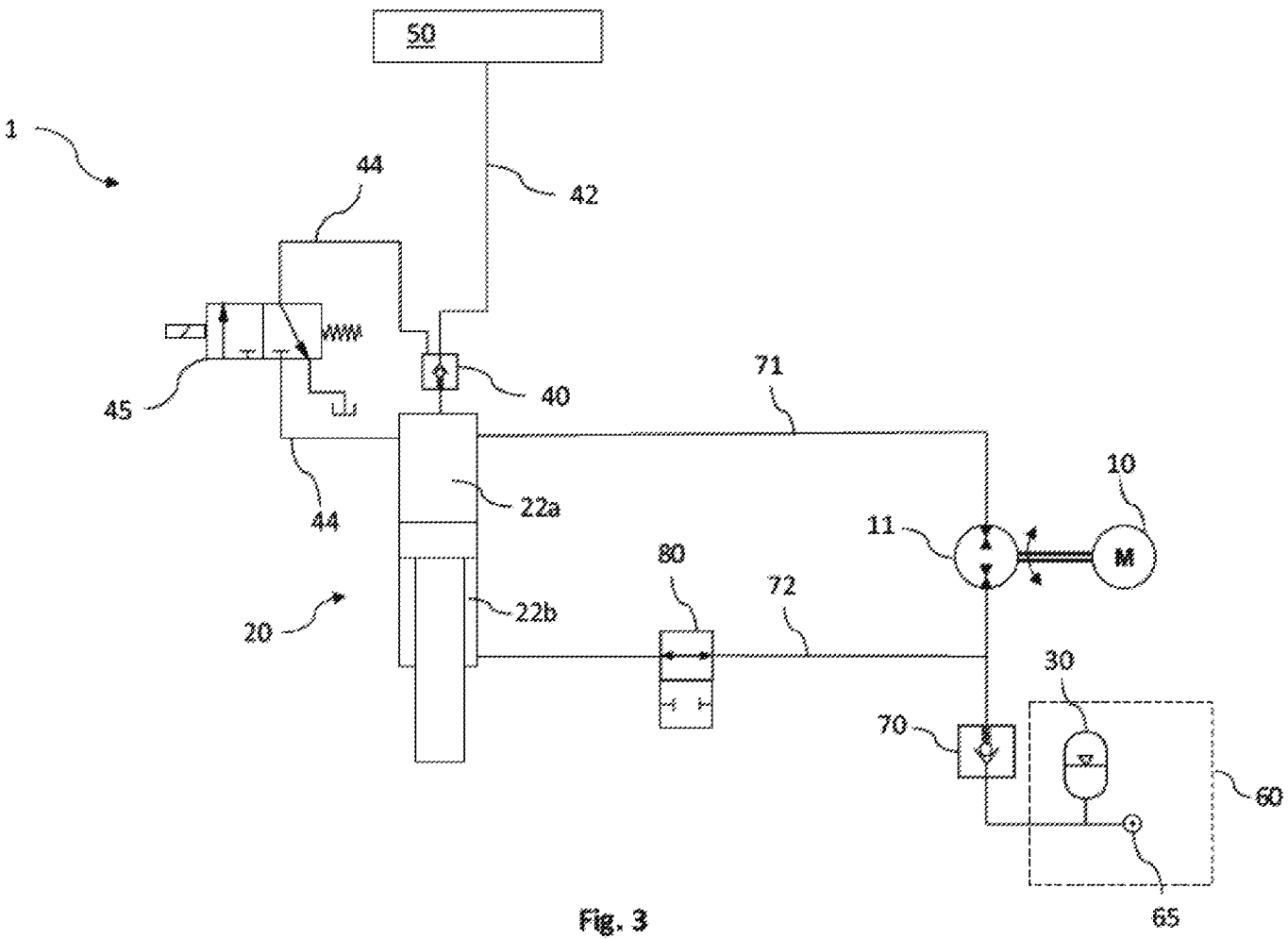
Figure 4:
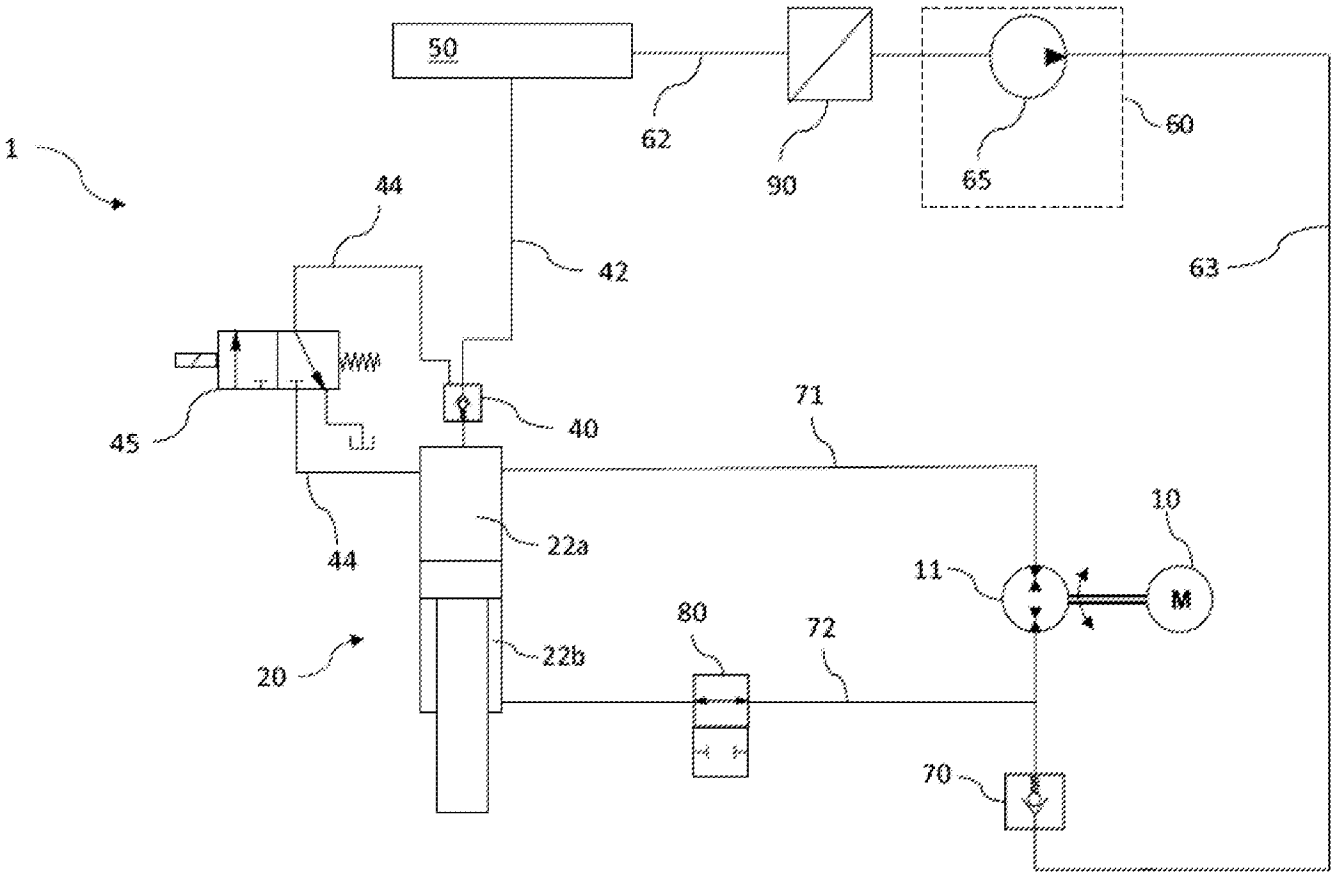
Figure 5:
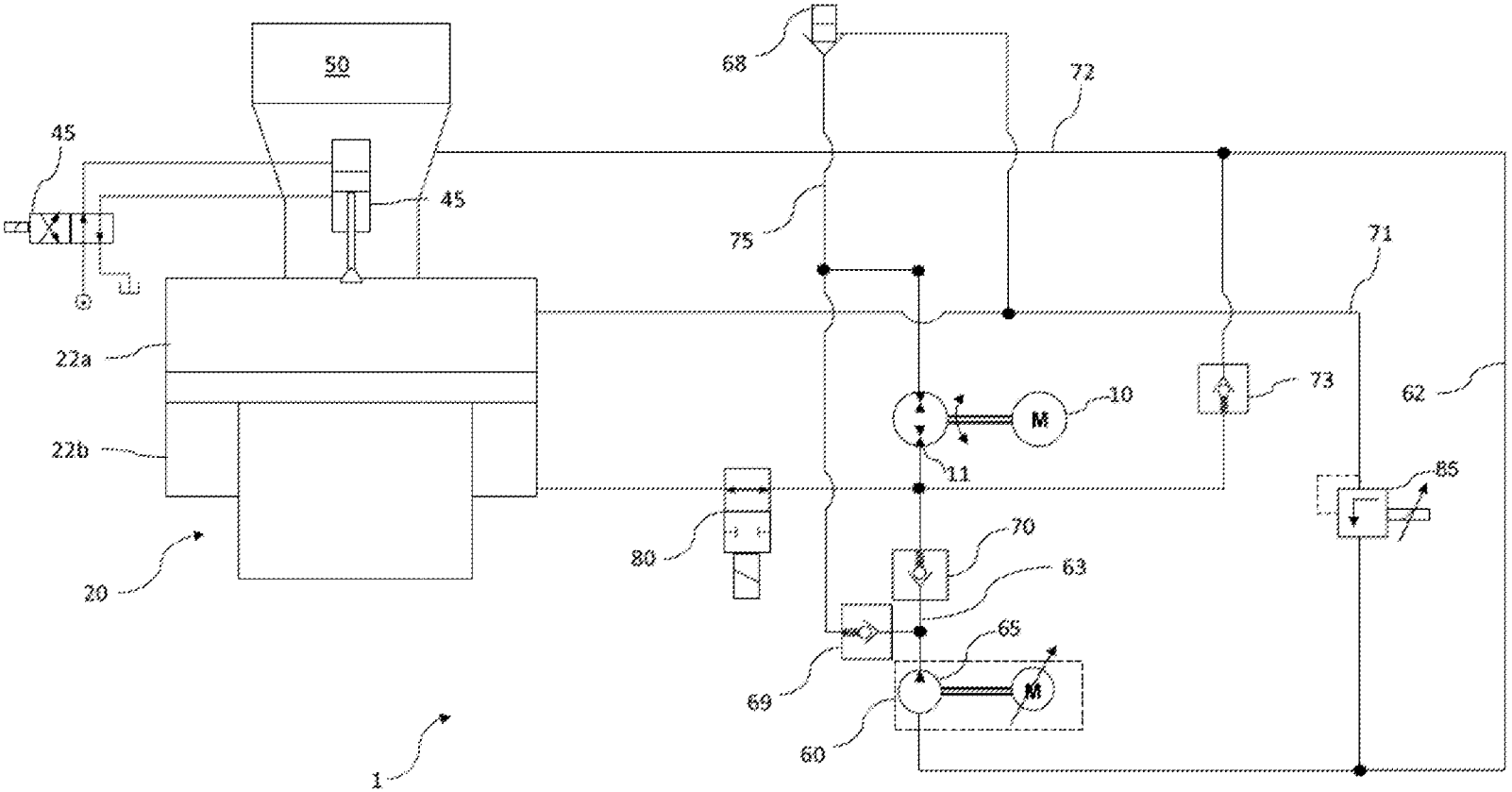

Shown are:

FIG. 1: a schematic representation of a system according to the invention;

FIG. 2*a*: a schematic representation of the configuration of the system according to the invention from FIG. 1 when extended in rapid motion;

FIG. 2*b*: a schematic representation of the configuration of the system according to the invention from FIG. 1 when extended in power motion;

FIG. 2*c*: a schematic representation of the configuration of the system according to the invention from FIG. 1 in decompression;

FIG. 2*d*: a schematic representation of the configuration of a further system according to the invention in an alternative type of decompression;

FIG. 2*e*: a schematic representation of the configuration of the system according to the invention from FIG. 1 when entering the rapid motion;

FIG. 3: a schematic representation of another embodiment of the system according to the invention;

FIG. 4: a schematic illustration of another embodiment of the system according to the invention, with a cleaning device;

FIG. 5: a schematic representation of another embodiment of the system according to the invention.

FIG. 1 shows an exemplary embodiment of an actuator system 1 according to the invention. The system comprises a differential cylinder 20 which has a piston side 22*a* and a ring side 22*b*.

The piston side 22*a* is hydraulically connected to the ring side 22*b* of the differential cylinder 20 by means of a line 71 and a line 72. A volume- and/or speed-variable hydraulic machine 11 driven by an electric motor 10 is arranged between the lines 71 and 72, wherein the hydraulic machine is a pump 11 in this exemplary embodiment according to the invention.

The line 71 thus connects the piston space 22*a* of the differential cylinder 20 to one connection of the pump 11, and the line 72 connects the ring side 22*b* of the differential cylinder to the other connection of the pump 11. Furthermore, a 2-way valve 80 which has a flow position and a locking position is connected in the line 72. This valve 80 serves as a safety valve and prevents, inter alia, the piston from falling off in the event of a defect in the actuator system 1 or in the operating sequence. Except in such emergency situations, the valve 80 is switched to flow.

The pump 11 can rotate in both directions of rotation according to the illustrated arrow and thus provide either a volumetric flow of hydraulic fluid in the direction of the piston side 22*a* or in the direction of the ring side 22*b* of the differential cylinder 20.

Further, a pretensioning source 60, which may include a pressure accumulator 30 and a source 65, is connected to the line 72 via a check valve 70. The hydraulic fluid in the pressure accumulator 30 is at a pressure which is preferably higher than the ambient pressure. In the event of a pressure loss in the system 1, the necessary pressure from the pressure accumulator 30 or from the pretensioning source 60 is fed into the actuator system 1 via the check valve 70.

The source 65 provides the actual pressure in the accumulator 30, while the pressure accumulator generally functions as a reservoir for volume balancing.

The arrangement of the expansion reservoir 50 is significant in this exemplary embodiment according to the invention. This is hydraulically connected above the differential cylinder 20 via the line 42 to the piston side 22*a* of the differential cylinder 20. Connected to the line 42 is a controlled directional valve 48 which has a flow position and a position with a check valve 40. The valve is electrically controllable.

The position of the valves in the description of FIG. 1 is to be understood only as an example, since this figure serves to describe the individual devices and their connection, and not to determine operating modes or the position of the valves in different operating situations; this takes place in the following FIG. 2.

FIG. 2*a* shows the exemplary embodiment of the system according to the invention from FIG. 1 in the rapid motion "downwards" operating state. Most of the elements used and the reference symbols are here the same as in FIG. 1.

This operating state is brought about when the piston of the differential cylinder is to be quickly moved downwards in the direction of the tool. The pump 11 operates to provide a flow of hydraulic fluid from the ring side 22*a* of the differential cylinder 20 towards the piston side 22*a* of the differential cylinder.

The safety valve 80 is set to flow, as in each operating state. The volume of the ring side 22*a* of the differential cylinder 20 is smaller than the volume of the piston side 22*a* of the differential cylinder 20.

As a result of the flow of the hydraulic fluid from the ring side 22*b* into the piston side 22*a* of the differential cylinder 20, further hydraulic fluid is therefore necessary in order to fill the piston side 22*a* and to achieve pressure balancing. The difference in volume is balanced by the expansion reservoir 50. For this purpose, the directional valve 48 is set such that the check valve 40 between the expansion reservoir 50 and the piston side 22*a* is opened, and hydraulic fluid flows from the expansion reservoir into the piston side.

Due to the increased volume in the piston side 22*a*, the pressure decreases to such an extent that the pressure of the hydraulic fluid in the expansion reservoir 50 is higher, and the check valve 40 opens. Thus, hydraulic fluid flows from the expansion reservoir 50 into the piston chamber 22*a* of the differential cylinder, thereby balancing the volume difference.

The differential cylinder 20 is moved according to the direction of the dashed arrow.

FIG. 2*b* shows the exemplary embodiment of the system according to the invention from FIG. 1 in the power motion "downwards" operating state. Most of the elements used and the reference symbols are here the same as in FIG. 1.

For the power motion downwards operating mode, less speed, but increased pressure or force, is usually required to actually machine the workpiece. In the power motion (also referred to as the pressing motion), the tool is pressed against the workpiece to be deformed, as a result of which an increased force is required, and thus an increased pressure of the hydraulic fluid has to be provided.

As can be seen from the exemplary embodiment according to the invention from FIG. 2*b*, the required increased pressure in the hydraulic fluid is to provided by the hydraulic machine. Here, as in FIG. 2*a*, the pump 11 operates by providing a hydraulic fluid flow from the ring side 22*b* of the differential cylinder 20 into the piston side 22*a* of the differential cylinder 20. The missing volumetric flow is supplemented by the pressure accumulators 30 or pretensioning source 60.

Since the pressure of the hydraulic fluid in the actuator system 1 is high—in this example, up to 400 bar—the check valve 48 remains closed, and there is no flow from or into the expansion reservoir 50.

In this operating mode, the piston of the differential cylinder 20 moves downwards according to the dashed arrow.

When the pressing operation is complete, a very high positive pressure prevails in the system 1, which is required for pressing, but which is superfluous after pressing. Accordingly, in order to reduce the pressure, decompression has to take place, in which the system 1 is relieved, but without causing a movement of the piston.

Decompression can occur according to, among others, two different exemplary embodiments.

FIG. 2*c* shows an exemplary embodiment of the system according to the invention during decompression. The directional valve 48 is switched from the position of the check valve to the flow position; thus, a volumetric flow into the expansion reservoir 50 according to the illustrated arrows is made possible.

The pressure of the hydraulic fluid in the ring side 22*b* and the piston chamber 22*a* relaxes, thereby filling the expansion reservoir.

An alternative type of decompression is illustrated in FIG. 2*d*. The system from FIG. 2*b*, instead of a single check valve 70, has a controlled, 2-way valve 75 disposed between the pressure accumulator 30 and the line 72.

In the previously described operating states, the 2-way valve 75 is switched as a check valve; in the case of decompression, it is switched to flow—as can be seen in FIG. 2*d*. Since the pressure of the hydraulic fluid in the cylinder spaces and the lines 71 and 72 is higher than in the pressure accumulator 30, two events occur when the valve 75 is switched to flow.

Firstly, the pressure in the entire system 1 relaxes, so that decompression takes place; secondly, a volumetric flow from the line 71 through the pump 11 into the pressure accumulator 30 takes place, as a result of which the volume of the pressure accumulator 30 is replenished, and the pressure of the hydraulic fluid in the pressure accumulator 30 is increased again.

This embodiment is advantageous, since energy is recovered in the pressure accumulator. Furthermore, by means of the volumetric flow from the piston chamber 22*a* through the pump 11 into the pressure accumulator 30, a movement of the pump 11 is brought about. The drive machine 10 thus operates as an energy generator and, furthermore, improves the energy recovery or reduces the energy loss.

The recovered energy can, according to the needs of the system 1, be reused, e.g., for the hydraulic machine.

When the pressing operation and the decompression are finished, the piston of the differential cylinder must be moved upwards again. The position of the valves and the volumetric flow of hydraulic fluid are shown in more detail in FIG. 2*e*. Most of the elements used and the reference symbols are here the same as in the previous figures.

As can be seen in FIG. 2*e*, the pump 11 operates in the reverse direction as in the rapid motion downwards, so that a volumetric flow is provided from the piston side 22*a* of the differential cylinder into the ring side 22*b* of the differential cylinder 20.

Since the volume of the piston side of the differential cylinder is greater than the volume of the ring side, a possibility must be provided for removing the superfluous hydraulic fluid from the circuit. For this purpose, the directional valve 48 is switched to flow, whereby the volume difference of the hydraulic fluid flows in the direction of the arrow from the piston side 22*a* of the differential cylinder 20 into the expansion reservoir 50. The piston of the differential cylinder is pushed upwards by the increased pressure in the ring side 22*b* and the low pressure in the piston side 22*a*.

FIG. 3 shows another exemplary embodiment of the system 1 according to the invention. Most of the elements used and the reference symbols are here the same as in FIG. 1.

The arrangement and control of the check valve 40 between the expansion reservoir 50 and the piston side 22*a* of the differential cylinder 20 is different, in contrast to FIG. 1.

As can be seen from FIG. 3, the check valve 40 is controlled by means of a control circuit comprising a 2-way valve 45. A line 44 connects the piston side 22*a* of the differential cylinder 20 to the check valve 40 via the 2-way valve.

The directional valve 45 has a flow position and a position in which the excess pressure is decompressed from the upper part of the line 44 and escapes into a reservoir. The check valve 40 is thus opened as a function of the pressure in the piston side 22*a*. Thus, when the pressure in the piston side 22*a* of the differential cylinder 20 is high enough and the valve 45 is switched to flow, the check valve 40 opens by the pressure of the piston side 22*a*. Since the valve 40 is open, the remaining hydraulic fluid can flow back into the expansion reservoir.

FIG. 4 shows another exemplary, non-limiting embodiment of the system from FIG. 3. As in FIG. 3, the check valve 40 is controlled by means of the control circuit or the 2-way valve 45.

In the pretensioning source 60, the pressure accumulator 30 of the previous figures has been replaced with a pump 65 in this exemplary embodiment according to the invention. The pump 65 operates in only one direction and accordingly has a pump inlet and a pump outlet. The pump inlet is connected to the expansion reservoir 50 by means of a line 62, while the pump outlet is connected to the line 72 via a line 63 above the check valve 70.

On the side of the line 63, the pump 65 operates like the pressure accumulator 30 from the previous figures, in which it generates an overpressure which is used for pretensioning the system.

In this exemplary embodiment, the hydraulic fluid used by the pump 65 is withdrawn from the expansion reservoir via the line 62.

As shown in FIG. 4, in this exemplary embodiment of the system 1 according to the invention, a cleaning device 90 for cleaning the hydraulic fluid is arranged between the expansion reservoir 50 and the pump 65. Thus, the hydraulic fluid drawn in by the pump 60 and accordingly fed into the line 72 is cleaned beforehand, and preferably also vented.

This embodiment is advantageous in that a closed circuit is provided in which the expansion reservoir 50 is used as a static means, e.g., for cooling the hydraulic fluid, and the hydraulic fluid can be cleaned by the cleaning device 90 and fed back into the system, instead of providing a further circuit which conveys and cleans the fluid in the expansion reservoir, but cannot be reused immediately.

FIG. 5 shows a system 1 corresponding to the system described above, but with a different arrangement.

As can be seen from FIG. 5, the connection between the expansion reservoir 50 and the piston side 22*a* of the differential cylinder 20 is ensured by means of a check valve 40 controlled by a control valve 45.

Furthermore, a line 72 via a check valve 73 connects the expansion reservoir 50 to the nodal point 100, through which the hydraulic fluid can be conducted both into the ring side 22*b* of the differential cylinder 20 and through the pump 11 into the line 71. Furthermore, the expansion reservoir 50 is hydraulically connected to the pretensioning source 60 and, in particular, to the inlet of the pump 65 by means of the line 72 and the line 62.

The pump 11 is connected to both the line 71 and the line 72.

The pretensioning of the hydraulic fluid is effected by means of the pretensioning source 60, wherein the pump 65 provides the pretensioning of the hydraulic fluid, similar to the embodiment of FIG. 4. This is a pump which can operate only on one side.

In the present exemplary embodiment according to the invention, an associated, controlled, proportional valve—especially, a controlled, proportional, pressure-limiting valve 85—is disposed on line 71 between pretensioning source 60 or pump 65 and piston side 22*a*. The proportional valve 85 preferably serves to decompress system 1, as explained in previous embodiments.

Further, a pretensioning valve 68 is hydraulically connected to the line 71 and hydraulically connected via the line 75 and a check valve 69 to the line 63, as well as to a connection of the hydraulic machine 11.

1 Electrohydrostatic actuator system
10 Electric motor
11 Hydraulic machine
20 Differential cylinder
22*a* Piston side
22*b* Ring side
30 Pressure accumulator
40 Check valve
41, 42 Line
45 2-way control valve
48 Controlled 2-way valve
50 Expansion reservoir
60 Pretensioning source
62 Line
63 Line
65 Pump
66 Check valve
68 Pretensioning valve
69 Check valve
70 Check valve
72 Line
75 Line
80 Valve
85 Proportional valve
90 Cleaning device

The invention claimed is:

1. An electrohydrostatic actuator system, comprising:

a hydraulic machine driven by an electric motor, wherein the hydraulic machine comprises at least a variable-volume or a variable speed, wherein the hydraulic machine is arranged to provide a volumetric flow of a hydraulic fluid;

a differential cylinder having a piston side and a ring side;

at least one pretensioning source;

a closed hydraulic circuit, wherein the hydraulic fluid in the hydraulic circuit is pressurized by at least the hydraulic machine or the pretensioning source during operation; and an expansion reservoir connected to the piston side of the differential cylinder via a first valve, wherein the expansion reservoir is operable to balance a volume of the hydraulic fluid in the closed hydraulic circuit;

a second valve arranged to connect the piston side of the differential cylinder to the pretensioning source or to the expansion reservoir;

wherein the actuator system has operating modes of a power motion and a rapid motion which are provided by the differential cylinder.

2. The electrohydrostatic actuator system according to claim 1, wherein the hydraulic fluid is pretensioned in the expansion reservoir at a pressure of less than 5 bar.

3. The electrohydrostatic actuator system according to claim 1, wherein the hydraulic fluid in the expansion reservoir has at least an ambient pressure or is arranged above the piston side of the differential cylinder.

4. The electrohydrostatic actuator system according to claim 1, wherein the expansion reservoir has a volume equal to or more than a volume difference of the closed system in a power end position and upper end position of the differential cylinder.

5. The electrohydrostatic actuator system according to claim 1, wherein the first valve is a controlled check valve.

6. The electrohydrostatic actuator system according to claim 5, wherein the controlled check valve is arranged to be unlocked by a 2-way valve.

7. The electrohydrostatic actuator system according to claim 1, wherein the first valve comprises:

a controlled 2-way valve with a flow position; or an electrically-controlled 3-way valve with a flow position, a locking position, and a check function.

8. The electrohydrostatic actuator system according to claim 1, wherein the hydraulic fluid of the pretensioning source has a pressure between 5 bar and 50 bar.

9. The electrohydrostatic actuator system according to claim 1, wherein the pretensioning source is hydraulically connected via a third valve to a line between a connection of the hydraulic machine and the ring side of the differential cylinder.

10. The electrohydrostatic actuator system according to claim 9, wherein the third valve is a check valve.

11. The electrohydrostatic actuator system according to claim 1, wherein the hydraulic machine comprises a first pump, and the pretensioning source comprises at least an accumulator or a second pump.

12. The electrohydrostatic actuator system according to claim 11, wherein the pretensioning source comprises the second pump, and wherein the second pump has a pump inlet connected via a first line to the expansion reservoir, and a pump outlet connected via a second line to a third valve.

13. The electrohydrostatic actuator system according to claim 1, wherein at least one valve with a flow position and a locking position is arranged in a line between the ring side of the differential cylinder and a connection of the hydraulic machine.

14. The electrohydrostatic actuator system according to claim 1, wherein the hydraulic machine comprises a pump having a first pump connection to the ring side of the differential cylinder and a second pump connection to the piston side of the differential cylinder, and wherein the hydraulic machine is configured to be pressurized on both the first and second pump connections.

15. The electrohydrostatic actuator system according to claim 1, wherein the second valve is a proportional valve.

16. The electrohydrostatic actuator system according to claim 1, wherein the pretensioning source includes a pump, and the closed system includes a device operable to clean the hydraulic fluid, wherein the device is arranged between the expansion reservoir and a pump inlet of the pump or between a pump outlet of the pump and a third valve.

17. The electrohydrostatic actuator system according to claim 1, wherein the expansion reservoir includes at least a device operable to vent the hydraulic fluid or a device operable to cool the hydraulic fluid.

18. The electrohydrostatic actuator system according to claim 1, further comprising two or more differential cylinders.

19. A method for operating an electrohydrostatic actuator system, comprising:

providing a variable-volume and/or variable-speed hydraulic machine driven by an electric motor, wherein the hydraulic machine is arranged to provide a volumetric flow of a hydraulic fluid;

providing a differential cylinder having a piston side and a ring side;

providing at least one pretensioning source;

providing a closed hydraulic circuit, wherein the hydraulic fluid in the hydraulic circuit is pressurized by the hydraulic machine and/or the pretensioning source during operation;

providing an expansion reservoir connected to the piston side of the differential cylinder via a first valve, wherein the expansion reservoir is operable to balance a volume of the hydraulic fluid in the closed hydraulic circuit; and providing a second valve arranged to connect the piston side of the differential cylinder to the pretensioning source or to the expansion reservoir;

wherein the differential cylinder provides a power motion and a rapid motion operating mode;

extending the differential cylinder piston in the rapid motion operating mode, wherein the expansion reservoir is arranged to convey the hydraulic fluid into the piston side of the differential cylinder, whereby a volume of the hydraulic fluid in the closed system is balanced.

20. The electrohydrostatic actuator system according to claim 1, wherein the electrohydrostatic actuator system is in a hydraulic press, a deep-drawing device, or an injection-molding device.

* * * * *